US006890249B1

(12) United States Patent
Zuniga et al.

(10) Patent No.: US 6,890,249 B1
(45) Date of Patent: May 10, 2005

(54) CARRIER HEAD WITH EDGE LOAD RETAINING RING

(75) Inventors: Steven M. Zuniga, Soquel, CA (US); Ming-Kuei Tseng, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 78 days.

(21) Appl. No.: 10/327,236

(22) Filed: Dec. 20, 2002

Related U.S. Application Data

(60) Provisional application No. 60/343,878, filed on Dec. 27, 2001.

(51) Int. Cl.[7] ..... B24B 47/02

(52) U.S. Cl. ..... 451/398; 451/41; 451/177; 451/285; 451/286; 451/287; 451/288; 451/289; 451/364; 451/388; 451/399

(58) Field of Search ..... 451/41, 177, 285, 451/286, 287, 288, 289, 364, 388, 399

(56) References Cited

U.S. PATENT DOCUMENTS

| | | | | |
|---|---|---|---|---|
| 4,918,869 A | | 4/1990 | Kitta | |
| 5,205,082 A | | 4/1993 | Shendon et al. | |
| 5,398,459 A | | 3/1995 | Okumura et al. | |
| 5,423,558 A | | 6/1995 | Koeth et al. | |
| 5,423,716 A | | 6/1995 | Strasbaugh | |
| 5,527,209 A | | 6/1996 | Volodarsky et al. | |
| 5,584,751 A | * | 12/1996 | Kobayashi et al. | 451/288 |
| 5,605,488 A | | 2/1997 | Ohashi et al. | |
| 5,624,299 A | | 4/1997 | Shendon | |
| 5,643,053 A | | 7/1997 | Shendon | |
| 5,643,061 A | | 7/1997 | Jackson et al. | |
| 5,650,346 A | | 7/1997 | Pan et al. | |
| 5,695,392 A | | 12/1997 | Kim | |
| 5,720,845 A | | 2/1998 | Liu | |
| 5,733,182 A | * | 3/1998 | Muramatsu et al. | 451/289 |
| 5,762,539 A | | 6/1998 | Nakashiba et al. | |
| 5,803,799 A | | 9/1998 | Volodarsky et al. | |
| 5,851,140 A | | 12/1998 | Barns et al. | |
| 5,879,220 A | | 3/1999 | Hasegawa et al. | |
| 6,095,900 A | * | 8/2000 | Fruitman et al. | 451/28 |
| 6,132,298 A | | 10/2000 | Zuniga et al. | |
| 6,350,346 B1 | | 2/2002 | Nakashiba et al. | |
| 6,375,549 B1 | * | 4/2002 | Glashauser et al. | 451/41 |

FOREIGN PATENT DOCUMENTS

| | | |
|---|---|---|
| JP | 5-69310 | 3/1993 |
| JP | 6-91522 | 4/1994 |

* cited by examiner

*Primary Examiner*—Joseph J. Hall, III
*Assistant Examiner*—Shantese McDonald
(74) *Attorney, Agent, or Firm*—Fish & Richardson

(57) ABSTRACT

A carrier head for chemical mechanical polishing of a substrate having a front surface, a back surface and an edge. The carrier head has a base, an inner retaining ring positioned beneath the base, and an outer retaining ring surrounding the inner retaining ring to retain the inner retaining ring. The inner retaining ring has a main portion with a first surface to apply a load to a perimeter portion of the back surface of the substrate and an annular lower projection protruding downwardly from the main portion with a second surface to circumferentially surround the edge of the substrate to retain the substrate.

28 Claims, 4 Drawing Sheets

CARRIER HEAD WITH EDGE LOAD RETAINING RING

CROSS-REFERENCE TO RELATED APPLICATIONS

This application claims priority to U.S. Provisional Application Ser. No. 60/343,878, filed on Dec. 27, 2001.

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad can be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process can be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad. An uneven load distribution results in a non-uniform material removal and, consequently, in non-uniformity on the surface of the substrate.

A reoccurring problem in CMP is the so-called "edge-effect", i.e., the tendency of the substrate edge to be polished at a different rate than the substrate center. The edge effect typically results in overpolishing (the removal of too much material from the substrate) at the substrate perimeter, e.g., the outermost five to ten millimeters of a 200 millimeter (mm) wafer. Some methods used to control the pressure applied to the perimeter of substrate do not completely eliminate the edge effect.

Another problem is that engagement of the face of the substrate against the moving polishing pad results in a lateral force applied to the substrate. The lateral force tends to drive the substrate against the retaining ring, deforming the edges and corners of the substrate and creating a non-uniform pressure distribution. It is desirable to reduce the potential range of movement of the substrate and thereby improve the polishing uniformity.

Still another problem relates to difficulties with securing the substrate to the carrier head. Surface tension can cause the substrate to stick to the polishing pad when the carrier head is lifted away from the polishing pad.

SUMMARY

In one aspect, the invention features a carrier head for chemical mechanical polishing of a substrate having a front surface, a back surface and an edge. The carrier head has a base, an inner retaining ring positioned beneath the base, and an outer retaining ring surrounding the inner retaining ring to retain the inner retaining ring. The inner retaining ring has a main portion with a first surface to apply a load to a perimeter portion of the back surface of the substrate and an annular lower projection protruding downwardly from the main portion with a second surface to circumferentially surround the edge of the substrate to retain the substrate.

Implementations of the invention may include one or more of the following features. A bottom surface of the lower projection may be substantially parallel to the substrate and separated from a polishing pad by a gap. The inner retaining ring may include a radial outwardly projecting flange to prevent lateral movement of the inner retaining ring. The radial flange may engage an inner surface of the outer retaining ring to prevent lateral movement of the inner retaining ring. The flange may include a compressible layer to contact the outer retaining ring. A flexible membrane may extend below the base to define at least a portion of a first pressurizable membrane chamber. The flexible membrane may have a lower surface to apply pressure to a center portion of the back surface of the substrate. The outer retaining ring may rests gently on the polishing. Two annular radial flanges may protruding generally horizontally outwardly from the main portion of the inner retaining ring to provide an annular recess. A bumper may be positioned between the annular radial flanges to maintain spacing between the inner retaining ring and the outer retaining ring. The bumper may be formed of a compressible material and the inner retaining ring may be formed of a rigid material. The bumper member may have an oval cross-section. The lower projection of the inner load retaining ring may include at least two spaced-apart annular flanges protruding downwardly from the main portion. The spaced-apart flanges may include an inner flange and an outer flange. The inner flange may provide the second surface, and the outer flange may contact an inner surface of the outer retaining ring. The inner flange may be sufficiently flexible to provide a flexible interface between the substrate and the inner retaining ring. The outer flange may be sufficiently flexible to provide a flexible interface between the inner retaining ring and the outer retaining ring.

In another aspect, the invention features a carrier head for chemical mechanical polishing of a substrate having a front surface, a back surface and an edge. The carrier head has a base, a first flexible membrane portion, an inner retaining ring positioned beneath the base, and an outer retaining ring surrounding the inner edge-load retaining ring to retain the inner retaining ring. The first membrane portion extends beneath the base to define at least a portion of a first pressurizable chamber, and a lower surface of the first flexible membrane portion provides a first surface to apply a first load to a center portion of the back surface of the substrate. The inner retaining ring has a main portion with a second surface to apply a second load to a perimeter portion of the back surface of the substrate and annular lower projection protruding downwardly from the main portion with a third surface to circumferentially surround edge of the substrate to retain the substrate.

Implementations of the invention may include one or more of the following features. A bottom surface of the lower projection may be substantially parallel to the substrate and separated from a polishing pad by a gap. A high friction layer may be positioned between the second surface and the back surface of the perimeter of the substrate. The inner retaining ring may include a radial lip extending radially inwardly from a top surface of the inner retaining ring. Pressurization of the first pressurizable chamber may applys a downward pressure to the center portion of the back of the substrate and to the top surface of the inner load-edge retaining ring. The outer retaining ring may rest gently on the polishing pad.

In another aspect, the invention is directed to a carrier head for chemical mechanical polishing of a substrate having a front surface, a back surface and an edge. The carrier head has a base, an inner retaining ring positioned beneath the base, and a pressurizable chamber surrounding a main portion of the inner retaining ring. The main portion of the inner retaining ring has a first surface to apply a first load to a perimeter portion of the back surface of the substrate, and an annular lower projection protrudes downwardly from the main portion with a second surface to circumferentially surround the edge of the substrate to retain the substrate.

Implementations of the invention may include one or more of the following features. The pressurizable chamber may be formed of an elastic material. An outer retaining ring may surround the inner retaining ring. The pressurizable chamber may be positioned between the inner retaining ring and the outer retaining ring. The inner retaining ring may include a first plurality of circumferential arc segments and a second plurality of arc segments. The first plurality of arc segments may be formed of a rigid material, and the second plurality of arc segments may be formed of a compressible material. Pressurization of the pressurizable chamber may compress the retaining ring inwardly to reduce a diameter of the second surface of the inner edge load retaining ring.

In another aspect, the invention is directed to a carrier head for chemical mechanical polishing of a substrate having a front surface, a back surface and an edge. The carrier head has a base, a first flexible membrane portion extending beneath the base to define at least a portion of a first pressurizable chamber, an inner retaining ring positioned beneath the base, an outer retaining ring surrounding the inner edge load retaining ring to retain the inner retaining ring, and a second pressurizable chamber positioned between the main portion of the inner retaining ring and the outer retaining ring. A lower surface of the first flexible membrane portion provides a first surface to apply a first load to a center portion of the back surface of the substrate. The inner retaining ring has a main portion with a second surface to apply a second load to a perimeter portion of the back surface of the substrate and an annular lower projection protruding downwardly from the main portion with a third surface to circumferentially surround edge of the substrate to retain the substrate.

In another aspect, the invention is directed to a carrier head for chemical mechanical polishing of a substrate having a front surface, a back surface and an edge. The carrier head has a base and an inner retaining ring positioned beneath the base. The inner retaining ring has a main portion with a first surface to apply a load to a perimeter portion of the back surface of the substrate and an annular projection protruding downwardly from the main portion with a second surface to circumferentially surround edge of the substrate to retain the substrate. A first passage extends through the inner edge load ring to connect an aperture in the first surface with a pressure controller.

Implementations of the invention may include one or more of the following features. An outer retaining ring may have a second passage connecting the first passage to the pressure controller. A flexible tubing may fluidly couple the first passage to the second passage. The pressure controller may evacuate the first passage to generate a suction force on the substrate.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

In several drawings, only certain elements of the carrier heads are illustrated for simplicity. Like reference symbols in the various drawings indicate like elements.

DETAILED DESCRIPTION

Figure 1:
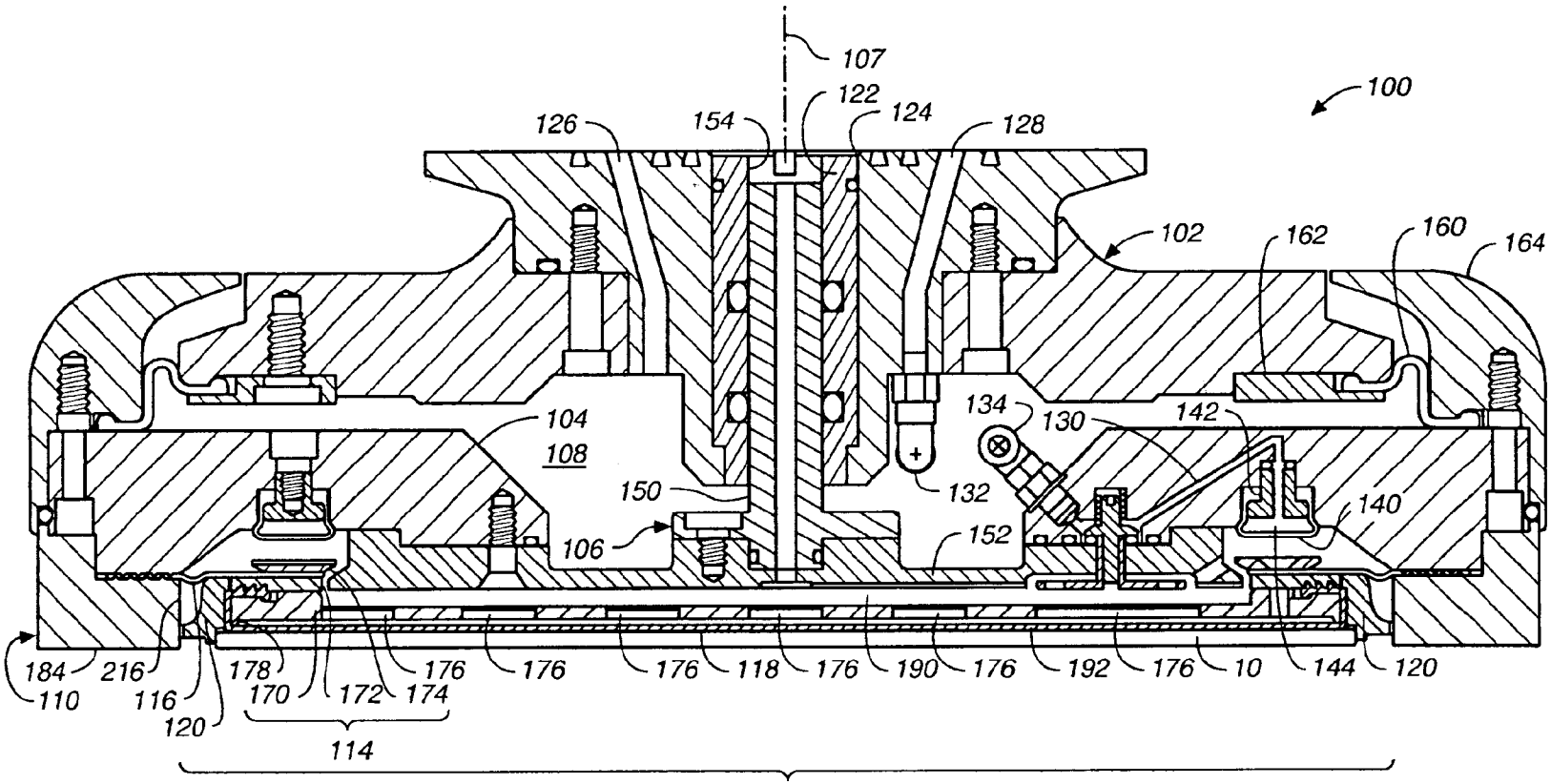
FIG. 1 is a schematic cross-sectional view of a carrier head according to the present invention.

Referring to FIG. 1, a substrate 10 is held by a carrier head 100 of a chemical mechanical polishing (CMP) apparatus. A description of a suitable CMP apparatus can be found in U.S. Pat. No. 5,738,574, the entire disclosure of that is hereby incorporated by reference.

Carrier head 100 includes a housing 102, a base 104, a gimbal mechanism 106 (which can also be considered part of the base 104), a loading chamber 108, an outer retaining ring 110, and a substrate backing assembly 112. A description of a similar carrier head can be found in U.S. Pat. No. 6,183,354, the entire disclosure of that is hereby incorporated by reference.

The housing 102 can be connected to a drive shaft to rotate therewith during polishing about an axis of rotation 107 that is substantially perpendicular to the surface of the polishing pad during polishing. The loading chamber 108 is located between the housing 102 and the base 104 to apply a load, i.e., a downward pressure, to the base 104. The vertical position of the base 104 relative to a polishing pad is also controlled by the loading chamber 108.

The housing 102 can be generally circular in shape to correspond to the circular configuration of the substrate to be polished. A cylindrical bushing 122 can fit into a vertical bore 124 through the housing 102, and two passages 126 and 128 can extend through the housing 102 for pneumatic control of the carrier head.

The base 104 is a generally ring-shaped body located beneath the housing 102. A passage 130 can extend through the base, and two fixtures 132 and 134 can provide attachment points to connect a flexible tube between the housing 102 and the base 104 to fluidly couple the two passages 128 and 130.

The gimbal mechanism 106 permits the base 104 to pivot with respect to the housing 102 so that the base can remain substantially parallel with the surface of the polishing pad. The gimbal mechanism 106 includes a gimbal rod 150 that fits into a passage 154 through the cylindrical bushing 122 and a flexure ring 152 that is secured to the base 104. The gimbal rod 150 can slide vertically along the passage 154 to provide vertical motion of the base 104, but it prevents any lateral motion of the base 104 with respect to the housing 102.

An inner edge of a rolling diaphragm 160 can be clamped to the housing 102 by an inner clamp ring 162, and an outer clamp ring 164 can clamp an outer edge of the rolling diaphragm 160 to the base 104. Thus, the rolling diaphragm 160 seals the space between the housing 102 and the base 104 to define the loading chamber 108. A second pump (not shown) can be fluidly connected to the loading chamber 108 to control the pressure in the loading chamber and the load applied to the base 104.

An annular bladder 140 can be secured to the bottom of the base 104 by an annular clamp ring 142 to form an annular chamber 144. By controlling fluid flow into the chamber 144 via the passage 130, the downward pressure on the substrate backing assembly 112 can be controlled.

The substrate backing assembly 112 includes a support structure 114, a flexure diaphragm 116 connecting the support structure 114 to the base 104, a flexible member or membrane 118 connected to the support structure 114, and an inner edge-loading retaining ring 120. The flexible membrane 118 extends below the support structure 114 and provides a surface 192 that engages a center portion of the substrate. The inner edge-loading retaining ring 120 extends around the support structure and engages a perimeter portion of the substrate. Pressurization of a chamber 190 positioned between the base 104 and the substrate backing assembly 112 forces the flexible membrane 118 downwardly to press the center portion of the substrate against the polishing pad. Pressurization of the chamber 190 also forces flexure diaphragm 116 downwardly to press against the inner edge-loading retaining ring 120 so that it presses the perimeter portion of the substrate against the polishing pad.

The support structure 114 of substrate backing assembly 112 includes a support plate 170, an annular lower clamp 172, and an annular upper clamp 174. The support plate 170 can be a generally disk-shaped rigid member having a plurality of apertures 176 formed therethrough. In addition, the support plate 170 can have a downwardly-projecting lip 178 at its outer edge.

The flexure diaphragm 116 of the substrate backing assembly 112 is a generally planar annular ring. An inner edge of flexure diaphragm 116 is clamped between the base 104 and the outer retaining ring 10, and an outer edge of the flexure diaphragm 116 is clamped between the lower clamp 172 and the upper clamp 174. The flexure diaphragm 116 is flexible and elastic, although it could be rigid in the radial and tangential directions.

The flexible membrane 118 is formed of a flexible and elastic material. A portion of the flexible membrane 118 extends around the edges of the support plate 170 to be clamped between the support plate 170 and the lower clamp 172.

The sealed volume between the flexible membrane 118, the support structure 114, the flexure diaphragm 116, the base 104, and the gimbal mechanism 106 defines the pressurizable chamber 190. A third pump (not shown) can be fluidly connected to the chamber 190 to control the pressure in the chamber and thus the downward forces of the flexible membrane on the substrate.

Figure 2:
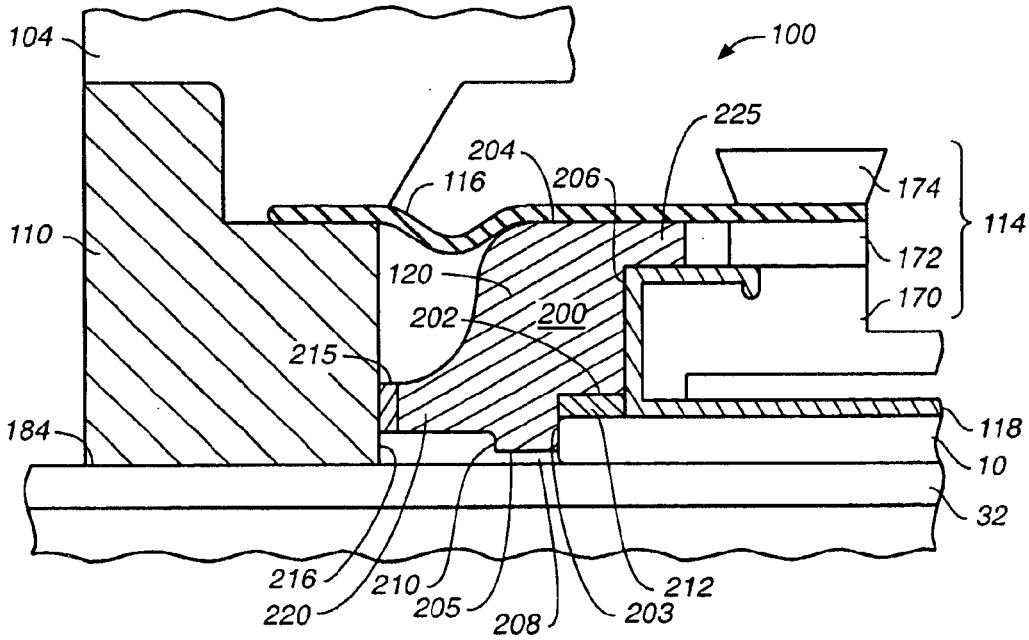
FIG. 2 is a cross-sectional view of an inner edge-load ring having an annular downward projection.

Referring to FIG. 2, the outer retaining ring 110 can be a generally annular ring secured at the outer edge of the base 104, e.g., by bolts (not shown). When fluid is pumped into the loading chamber 108 and the base 104 is pushed downwardly, the outer retaining ring 110 is also pushed downwardly to apply a load to a polishing pad 32. A bottom surface 184 of the outer retaining ring 110 can be substantially flat, or it can have a plurality of channels to facilitate transport of slurry from outside the retaining ring to the substrate. A generally vertical cylindrical inner surface 216 of the outer retaining ring 110 can engage an outwardly projecting flange 220 of the inner edge-load retaining ring 120 to retain the inner edge-load retaining ring beneath the carrier head. During polishing, the outer retaining ring 110 can rest gently on the polishing pad 32 with little or no applied pressure from loading chamber 108, and consequently the bottom surface 184 of the outer retaining ring 110 contacts the polishing pad 32 at low pressures. By reducing the downward pressure load on the outer retaining ring 110, the friction between the outer retaining ring 110 and the polishing pad 32 is reduced. The reduced friction decreases the wear of the outer retaining ring 110, thereby improving the retaining ring life and decreasing the amount of debris generated from the outer retaining ring 110. This also reduces scratches on the substrate that can result from the retaining ring debris.

The inner edge-load retaining ring 120 is a generally annular body located between the outer retaining ring 110 and support structure 114. The inner edge-load retaining ring 120 is composed of a material, such as a stainless steel, ceramic, anodized aluminum, or plastic, e.g., polyphenylene sulfide (PPS), that is relatively rigid compared to the flexible membrane.

The inner edge-load retaining ring 120 can include a main portion 200 with a rigid bottom surface 202 that applies pressure to a perimeter portion of the back surface of the substrate, a cylindrical inner surface 206 located adjacent to or spaced apart from a portion of flexible membrane 118, and an annular lower projection 210 that protrudes downwardly from the main portion 200 and surrounds the bottom surface 202 and the substrate 10. An optional layer 212 of a high friction compressible material can be adhesively attached to the bottom surface 202 to provide a mounting surface for the substrate. The lower projection 210 can have a cylindrical inner surface 203 that surrounds the substrate to prevent it from escaping from beneath the carrier head, and a substantially flat bottom surface 205 that can be separated from polishing pad 32 by a gap 208. When the chamber 190 is pressurized and the flexure diaphragm 116 is forced downwardly against the inner edge-load retaining ring 120, the surface 202 exerts a downward pressure on the high friction layer 212 that is transmitted through the layer 212 to the perimeter portion of the back surface of the substrate. In addition, the inner surface 203 of the lower projection 210 abuts the outer edge of the substrate to retain the substrate beneath the carrier head and prevent it from lateral movement.

The main portion 200 of the inner edge-loading retaining ring 120 can also have a radial outwardly projecting flange 220 that abuts the cylindrical inner surface 216 of the outer retaining ring 110. A flexible annular ring 215 of a compressible material can be located at the end of the flange 220 to prevent the inner edge-load retaining ring 120 from scratching or damaging the outer retaining ring 110. The main portion 200 can also include a lip 225 that extends over the flexible membrane 118 and the support structure 114. A common upper surface 204 of the main portion 200 and the lip 225 contacts flexure diaphragm 116.

In operation, fluid is pumped into the chamber 190 to control the downward pressure applied by the flexible membrane 118 against the center portion of the substrate. The pressure in the chamber 190 also exerts a force on the flexure diaphragm 116 to control the downward pressure applied by the inner edge-load retaining ring 120 against the perimeter portion of the substrate. When chamber 190 is pressurized, flexible membrane 118 will also expand laterally outward, and, if it does not already do so in the unpressurized state, might contact the inner surface 206 of the inner edge-load retaining ring 160.

When polishing is completed and the loading chamber 190 is evacuated to lift base 104 and backing structure 112 off the polishing pad, the top surface of the flexible membrane 118 engages the lip 225 of the inner edge-load retaining ring 120 to lift the inner edge-load retaining ring 120 off the polishing pad with the rest of the carrier head.

By selecting the surface area of the top surface 204 versus the surface area of the bottom surface 202, the relative pressure applied by the edge-loading retaining ring 120 to the substrate perimeter can be selected to reduce the edge effect. In addition, since the edge-loading retaining ring 120 is not secured by bolts or screws to other pieces, its surfaces are not subject to distortion by the attachment process, and consequently it does not introduce polishing non-uniformities. In addition, since the bottom surface 202 engages the top of the substrate 10, the edge-loading retaining ring 120 is self-referencing to the back of the substrate and can maintain the gap 205 between the projection 210 and the polishing pad 32. Since the edge-loading retaining ring 120 does not contact the polishing pad 32, it does not wear and does not produce debris that could interfere with the polishing process.

Figure 3:
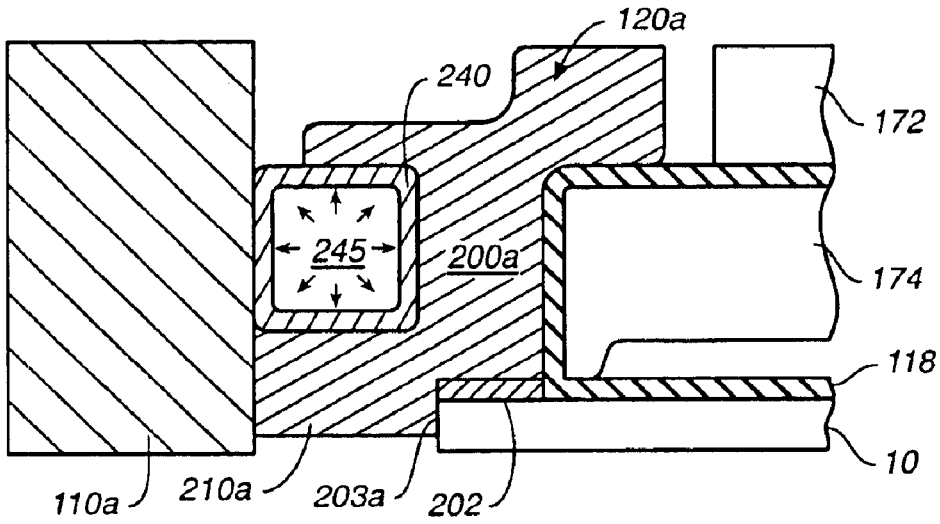
FIG. 3 is a cross-sectional view of an edge-load ring having a pressurized bladder between the inner edge-load retaining ring and an outer retaining ring.
Figure 3A:
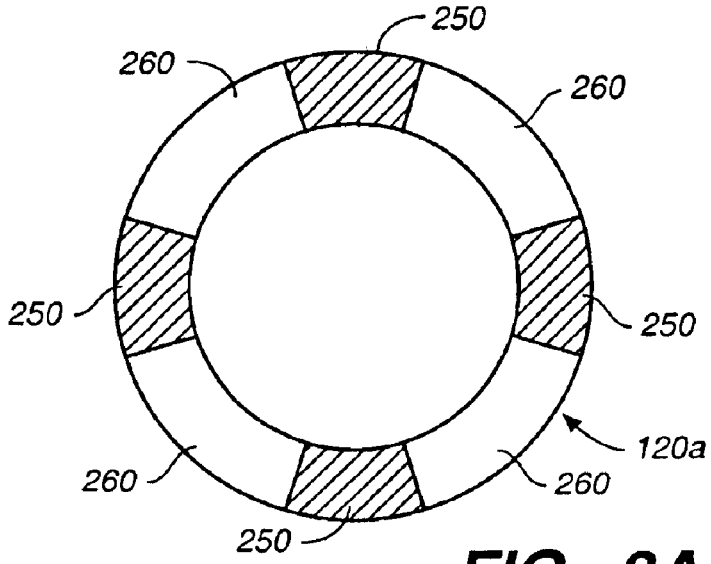
FIG. 3A is a top view of an edge load ring having compressible segments.

Referring to FIGS. 3 and 3A, in another implementation, an inner edge-load retaining ring 120*a* can also include an elastic member 240 that defines a pressurizable bladder 245. The bladder 245 can be positioned between a main portion 200*a* of the inner edge-load retaining ring 120*a* and an outer retaining ring 110*a*. In addition, the inner edge-load retaining ring 120*a* includes compressible arc segments 250 circumferentially inserted between rigid segments 260. When pressurized, the bladder 245 exerts a radially inward force on the inner edge-loading retaining ring 120*a*. This radial force compresses the compressible arc segments 250, causing the rigid segments 260 converge toward the center of the inner edge-load retaining ring 120*a*. The resulting circumferential contraction of the inner edge-load retaining ring 120*a* decreases the diameter of the cylindrical inner surface 203*a* of a lower projection 210*a*, thereby reducing or eliminating a gap between the inner edge-loading retaining ring 120*a* and the substrate edge. Without pressure in the bladder 245, the inner edge-load retaining ring 120*a* opens to a natural, decompressed state and thus releases the edge of the substrate.

By reducing or eliminating the gap between the inner surface 203*a* of the inner edge-load retaining ring 120*a* and the substrate, cylindrical surface 203*a* remains in immediate contact with the substrate edge. This reduces the probability of the substrate edge being deformed by the frictional force that drives the substrate against the inner surface 203*a*, thereby improving polishing uniformity.

Figure 4:
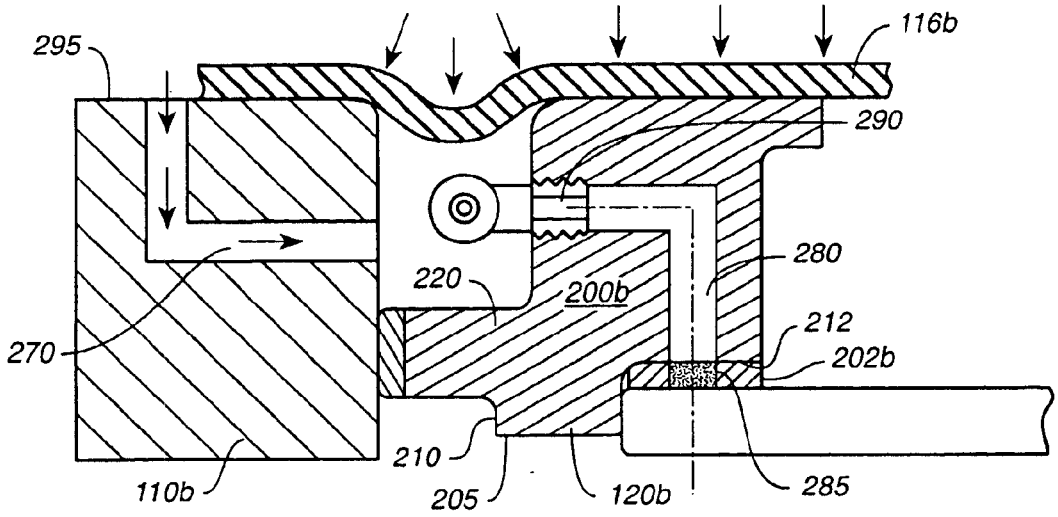
FIG. 4 is a cross-sectional view of an inner edge-load retaining ring having an air passage for vacuum-chucking of a substrate.

Referring to FIG. 4, in another implementation, an outer retaining ring 110*b* can include a passage 270 and an inner edge-load retaining ring 120*b* can include a passage 280 for pneumatic control of the perimeter portion of the substrate. Passages 270 and 280 can be connected by flexible tubing (not shown). Passage 280 can have an outlet 285 in the surface 202*b* of the inner edge-load retaining ring 120*b*. An independent pressure source, such as a pump, can be fluidly connected to the passage 270 through channels in the base and housing to direct fluid, e.g., a gas, such as air, into or out of the outlet 285. When vacuum is applied to the passages 270 and 280, the outlet 285 produces a suction force on the substrate and ensures vacuum-chucking of the back surface of the perimeter portion of the substrate to the carrier head. In operation, the vacuum suction outlet 285 grips the substrate prior to the membrane chamber evacuation, so that, as the carrier head is lifted away from the polishing pad, the vacuum in the suction outlet 285 holds the substrate on the carrier head. When vacuum is replaced by a positive pressure, the outward force urges the substrate off the carrier head. This configuration helps ensure greater reliability of vacuum-chucking and de-chucking of the substrate. Additionally, the pressurization of the passages 270 and 280 can be used to apply a downward pressure to the perimeter of the substrate during polishing.

Figure 5:
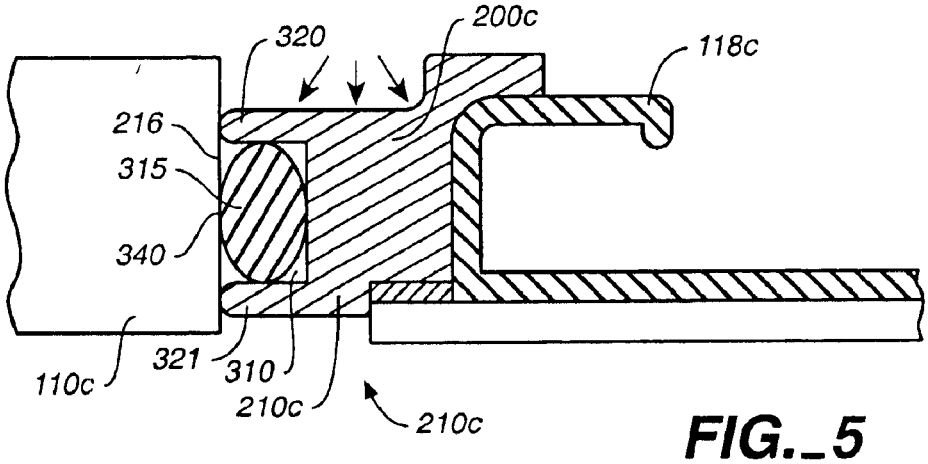
FIG. 5 is a cross-sectional view of a carrier head having an inner edge load retaining ring with a compressible bumper between the inner edge-load retaining ring and an outer retaining ring.

Referring to FIG. 5, in another embodiment, an inner edge-load retaining ring 120*c* has an annular inwardly extended cylindrical recess 310. The recess 310 can be formed by annular flanges 320 and 321 protruding outwardly and generally horizontally from the main portion 200*c* and the lower projection 210*c* respectively. The main portion 200*c*, the lower projection 210*c* and annular flanges 320 and 321 are made of a rigid material. A bumper 315 fits into the recess 310 between the flanges 320 and 321. The bumper 315 can be formed of a compressible material, and can have a generally oval cross-section. An outmost surface 340 of the bumper 315 engages an inner surface 216*c* of an outer retaining ring 10*c*. Thus, the bumper 315 maintains a proper spacing between the outer retaining ring 110*c* and the inner edge-load retaining ring 120*c*. This configuration can also reduce damage to the outer retaining ring that would result from a rigid contact between the inner surface 216*c* and the inner edge-load retaining ring 120*c*.

Figure 6:
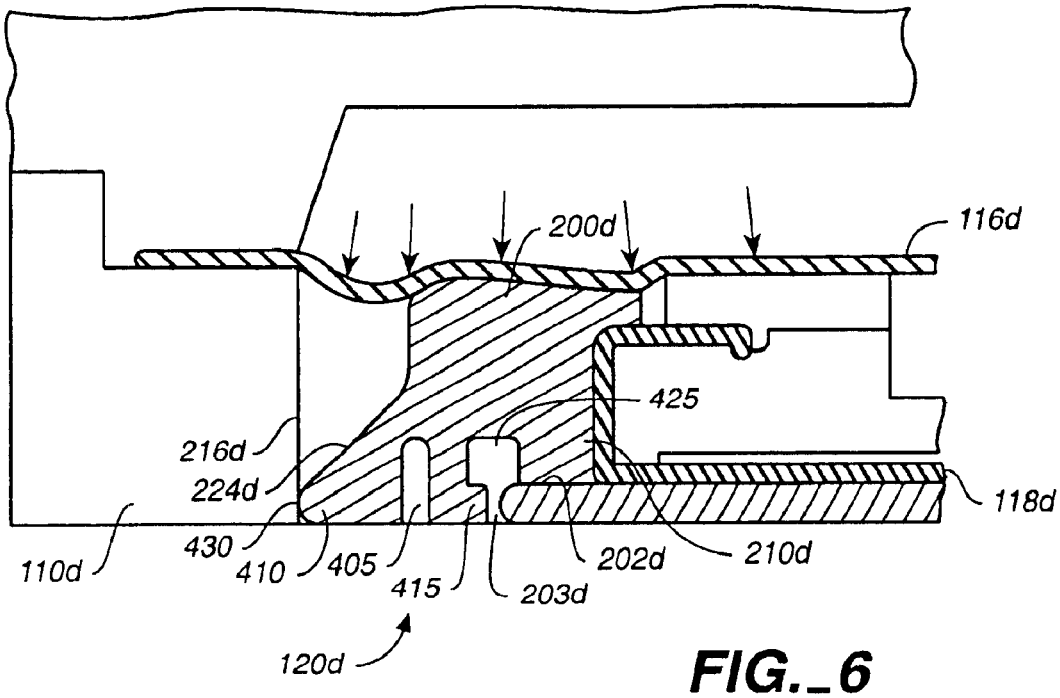
FIG. 6 is a cross-sectional view of a carrier head having an inner edge load retaining ring with annular flanges that provide flexible interfaces with the substrate and the outer retaining ring.

Referring to FIG. 6, in another embodiment, an inner edge-load retaining ring 120*d* has a generally rigid annular body 200*d* and a two-prong lower projection 210*d*. The two prongs can be formed by two spaced apart annular flanges, e.g., an outer flange 410 and an inner flange 415 both protruding generally downwardly from the main portion 200*d*. Flanges 410 and 415 are separated by an annular gap 405. Additionally, the inner flange 415 is separated from the annular projection 210*d* by an annular gap 425. The main portion 200*d* can provide a surface 202*d* for contact with the perimeter portion of the back surface of the substrate. The inner flange 415 provides a cylindrical, generally vertical inner surface 203*d* that surrounds the substrate edge to prevent it from escaping from beneath the carrier head. The outer flange 410 can terminate in an arcuate outer surface 221*d* with an outermost generally rounded portion 430. The rounded portion 430 can reduce scratching or damage from the inner edge load retaining ring 120*d*.

Due to the annular gaps 405 and 425, the inner flange 415 is generally free to flex radially inward or outward. Specifically, the gaps 405 and 425 enable the inner flange 415 to flex back when the edge of the substrate is forced against the inner surface 203*d* by the frictional force from the polishing pad. Since part of the edge effect can be caused by deformation of the substrate where it is forced against the inner edge-load retaining ring 120*d*, providing the flexible interface between the inner edge-load retaining ring 120*d* and the edge of the substrate can improve the polishing uniformity.

The present invention has been described in terms of a number of implementations. The invention, however, is not limited to the embodiments depicted and described. Many elements not related to the edge-loading retaining ring could be modified, combined or eliminate. For example, the upper chamber 108 could be eliminated, or the flexure 116 and the flexible membrane 118 could be a single part. Thus, the scope of the invention is defined by the appended claims.

What is claimed is:

1. A carrier head for chemical mechanical polishing of a substrate having a front surface, a back surface and an edge, comprising:

a base:

an inner retaining ring positioned beneath the base and having a main portion with a first surface to apply a load to a perimeter portion of the back surface of the substrate and having an annular lower projection protruding downwardly from the main portion with a second surface to circumferentially surround the edge of the substrate to retain the substrate; and an outer retaining ring surrounding the inner retaining ring to retain the inner retaining ring;

wherein the inner retaining ring includes a first radial outwardly projecting flange to prevent lateral movement of the inner retaining ring.

2. The carrier head of claim 1, wherein the radial flange engages an inner surface of the outer retaining ring to prevent lateral movement of the inner retaining ring.

3. The carrier head of claim 1, further comprising a second radial flange protruding generally horizontally outwardly from the main portion of the inner retaining ring, wherein the first radial outwardly projecting flange and the second radial flange provide an annular recess.

4. The carrier head of claim 3, further comprising a bumper positioned between the annular radial flanges to maintain spacing between the inner retaining ring and the outer retaining ring.

5. The carrier head of claim 4, wherein the bumper is formed of a compressible material and the inner retaining ring is formed of a rigid material.

6. The carrier head of claim 5, wherein the bumper member has an oval cross-section.

7. A carrier head for chemical mechanical polishing of a substrate having a front surface, a back surface and an edge, comprising:

a base;

an inner retaining ring positioned beneath the base and having a main portion with a first surface to apply a load to a perimeter portion of the back surface of the substrate and having an annular lower projection protruding downwardly from the main portion with a second surface to circumferentially surround the edge of the substrate to retain the substrate; and an outer retaining ring surrounding the inner retaining ring to retain the inner retaining ring, wherein the inner retaining ring has a radial outwardly projecting flange to engage an inner surface of the inner retaining ring and prevent lateral movement of the inner retaining ring, the flange having a compressible layer to contact the outer retaining ring.

8. The carrier head of claim 7, further comprising a flexible membrane extending below the base to define at least a portion of a first pressurizable membrane chamber, the flexible membrane having a lower surface to apply pressure to a center portion of the back surface of the substrate.

9. The carrier head of claim 8, wherein the outer retaining ring rests gently on the polishing pad.

10. A carrier head for chemical mechanical polishing of a substrate having a front surface, a back surface and an edge, comprising:

a base;

an inner retaining ring positioned beneath the base and having a main portion with a first surface to apply a load to a perimeter portion of the back surface of the substrate and having an annular lower projection protruding downwardly from the main portion with a second surface to circumferentially surround the edge of the substrate to retain the substrate wherein the annular lower projection includes at least two spaced-apart annular flanges protruding downwardly from the main portion; and an outer retaining ring surrounding the inner retaining ring to retain the inner retaining ring.

11. The carrier head of claim 10, wherein the spaced-apart flanges include an inner flange and an outer flange, the inner flange providing the second surface, and the outer flange contacting an inner surface of the outer retaining ring.

12. The carrier head of claim 10, wherein the inner flange is sufficiently flexible to provide a flexible interface between the substrate and the inner retaining ring.

13. The carrier head of claim 10, wherein the outer flange is sufficiently flexible to provide a flexible interface between the inner retaining ring and the outer retaining ring.

14. A carrier head for chemical mechanical polishing of a substrate having a front surface, a back surface and an edge, comprising:

a base;

a first flexible membrane portion extending beneath the base to define at least a portion of a first pressurizable chamber, a lower surface of the first flexible membrane portion providing a first surface to apply a first load to a center portion of the back surface of the substrate;

an inner retaining ring positioned beneath the base and having a main portion with a second surface to apply a second load to a perimeter portion of the back surface of the substrate and having an annular lower projection protruding downwardly from the main portion with a third surface to circumferentially surround the edge of the substrate to retain the substrate, wherein a bottom surface of the lower projection is substantially parallel to the substrate and during polishing is separated from a polishing pad by a gap;

an outer retaining ring surrounding the inner retaining ring to retain the inner retaining ring; and a high friction layer positioned between the second surface and the back surface of the perimeter of the substrate.

15. The carrier head of claim 14, wherein the inner retaining ring includes a radial lip extending radially inwardly from a top surface of the inner retaining ring.

16. The carrier head of claim 15, wherein pressurization of the first pressurizable chamber applies a downward pressure to the center portion of the back of the substrate and to the top surface of the inner retaining ring.

17. The carrier head of claim 16, wherein the outer retaining ring rests gently on the polishing pad.

18. A carrier head for chemical mechanical polishing of a substrate having a front surface, a back surface and an edge, comprising:

a base;

an inner retaining ring positioned beneath the base and having a main portion with a first surface to apply a first load to a perimeter portion of the back surface of the substrate and having an annular lower projection protruding downwardly from the main portion with a second surface to circumferentially surround the edge of the substrate to retain the substrate; and a pressurizable chamber surrounding the main portion of the inner retaining ring.

19. A carrier head for chemical mechanical polishing of a substrate having a front surface, a back surface and an edge, comprising:

a base;

an inner retaining ring positioned beneath the base and having a main portion with a first surface to apply a first load to a perimeter portion of the back surface of the substrate and having an annular lower projection protruding downwardly from the main portion with a second surface to circumferentially surround the edge of the substrate to retain the substrate; and a pressurizable chamber surrounding the main portion of the inner retaining ring wherein the pressurizable chamber is formed of an elastic material.

20. The carrier head of claim 19, further comprising an outer retaining ring, and wherein the pressurizable chamber is positioned between the inner retaining ring and the outer retaining ring.

21. The carrier head of claim 20, wherein the inner retaining ring includes a first plurality of circumferential arc segments and a second plurality of arc segments.

22. The carrier head of claim 21, wherein the first plurality of arc segments are formed of a rigid material, and the second plurality of arc segments are formed of a compressible material.

23. The carrier head of claim 22, wherein pressurization of the pressurizable chamber compresses the retaining ring inwardly to reduce a diameter of the second surface of the inner retaining ring.

24. A carrier head for chemical mechanical polishing of a substrate having a front surface, a back surface and an edge, comprising:

a base;

a first flexible membrane portion extending beneath the base to define at least a portion of a first pressurizable chamber, a lower surface of the first flexible membrane portion providing a first surface to apply a first load to a center portion of the back surface of the substrate;

an inner retaining ring positioned beneath the base and having a main portion with a second surface to apply a second load to a perimeter portion of the back surface of the substrate and having an annular lower projection protruding downwardly from the main portion with a third surface to circumferentially surround the edge of the substrate to retain the substrate;

an outer retaining ring surrounding the inner retaining ring to retain the inner retaining ring; and a second pressurizable chamber positioned between the main portion of the inner retaining ring and the outer retaining ring.

25. A carrier head for chemical mechanical polishing of a substrate having a front surface, a back surface, and an edge, comprising:

a base;

an inner retaining ring positioned beneath the base and having a main portion with a first surface to apply a load to a perimeter portion of the back surface of the substrate and having an annular lower projection protruding downwardly from the main portion with a second surface to circumferentially surround an edge of the substrate to retain the substrate; and a first passage through the inner retaining ring connecting an aperture in the first surface with a pressure controller.

26. The carrier head of claim 25, further comprising an outer retaining ring with a second passage connecting the first passage to the pressure controller.

27. The carrier head of claim 26, further comprising a flexible tubing fluidly coupling the first passage to the second passage.

28. The carrier head of claim 27, wherein the pressure controller evacuates the first passage to generate a suction force on the substrate.

* * * * *